US005794380A

United States Patent [19]

Guardia

[11] Patent Number: 5,794,380

[45] Date of Patent: Aug. 18, 1998

[54] LOUVRE WINDOW CLIP ASSEMBLY

[75] Inventor: James F. Guardia, Yorba Linda, Calif.

[73] Assignee: Reflectolite Products Company, Inc., Sun Valley, Calif.

[21] Appl. No.: 788,317

[22] Filed: Jan. 24, 1997

[51] Int. Cl.[6] ..... E06B 7/08

[52] U.S. Cl. ..... 49/74.1; 49/403

[58] Field of Search ..... 49/74.1, 86.1, 49/82.1, 403, 506

[56] References Cited

U.S. PATENT DOCUMENTS

| | | | |
|---|---|---|---|
| 2,726,426 | 12/1955 | Biggs . | |
| 2,770,853 | 11/1956 | Groff et al. . | |
| 3,205,541 | 9/1965 | Beards | 49/403 X |
| 3,375,608 | 4/1968 | Thompson | 49/403 |
| 4,226,051 | 10/1980 | Thompson | 49/403 |
| 4,524,978 | 6/1985 | Mauser . | |
| 4,570,394 | 2/1986 | Jentoft et al. . | |
| 4,630,399 | 12/1986 | Okumoto . | |
| 4,813,183 | 3/1989 | Jordal . | |
| 5,194,312 | 3/1993 | Verig . | |
| 5,217,786 | 6/1993 | Keys . | |
| 5,305,533 | 4/1994 | Shimizu et al. . | |
| 5,466,508 | 11/1995 | Brocke et al. . | |

FOREIGN PATENT DOCUMENTS

| | | | |
|---|---|---|---|
| 118 417 | 5/1944 | Australia . | |
| 202 791 | 1/1956 | Australia . | |
| 532 274 | 5/1979 | Australia . | |
| 654 187 | 1/1965 | Belgium . | |
| 539254 | 4/1957 | Canada | 49/403 |
| 375 014 | 6/1932 | United Kingdom . | |
| 579 490 | 8/1946 | United Kingdom . | |
| 623 828 | 5/1949 | United Kingdom . | |
| 679 600 | 9/1952 | United Kingdom . | |
| 725 846 | 3/1955 | United Kingdom . | |
| 1 116 831 | 6/1968 | United Kingdom . | |
| 1 396 285 | 6/1975 | United Kingdom . | |

*Primary Examiner*—Jerry Redman
*Attorney, Agent, or Firm*—Hill & Simpson

[57] ABSTRACT

A louvre window clip assembly that is used with a window frame. The clip assembly includes a clip, that is capable of receiving a glass window pane, and a hub. The hub and clip are engaged so that the clip is removable from the exterior of the window frame without having to access the interior of the window frame.

8 Claims, 4 Drawing Sheets

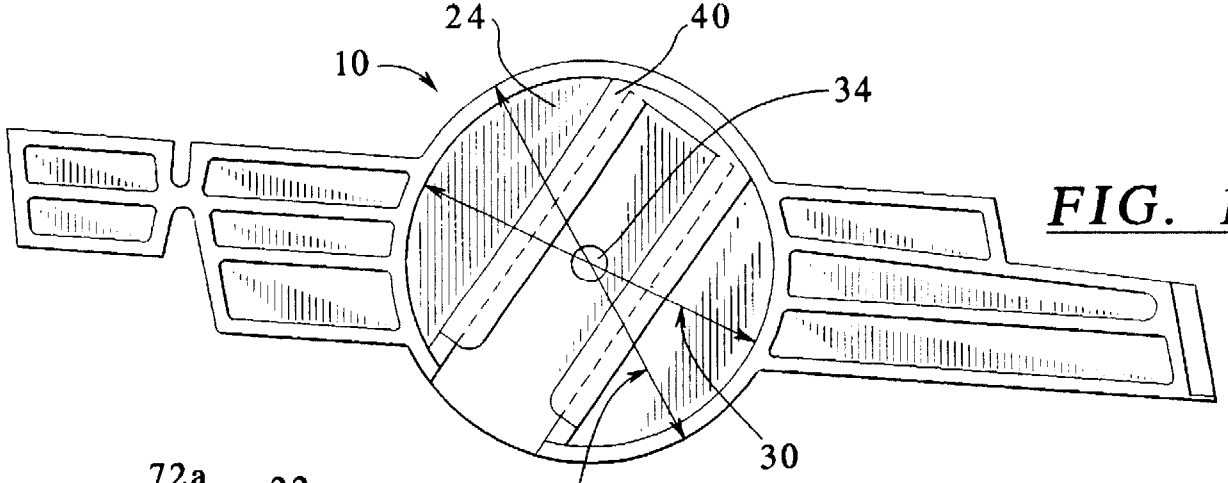
FIG. 1
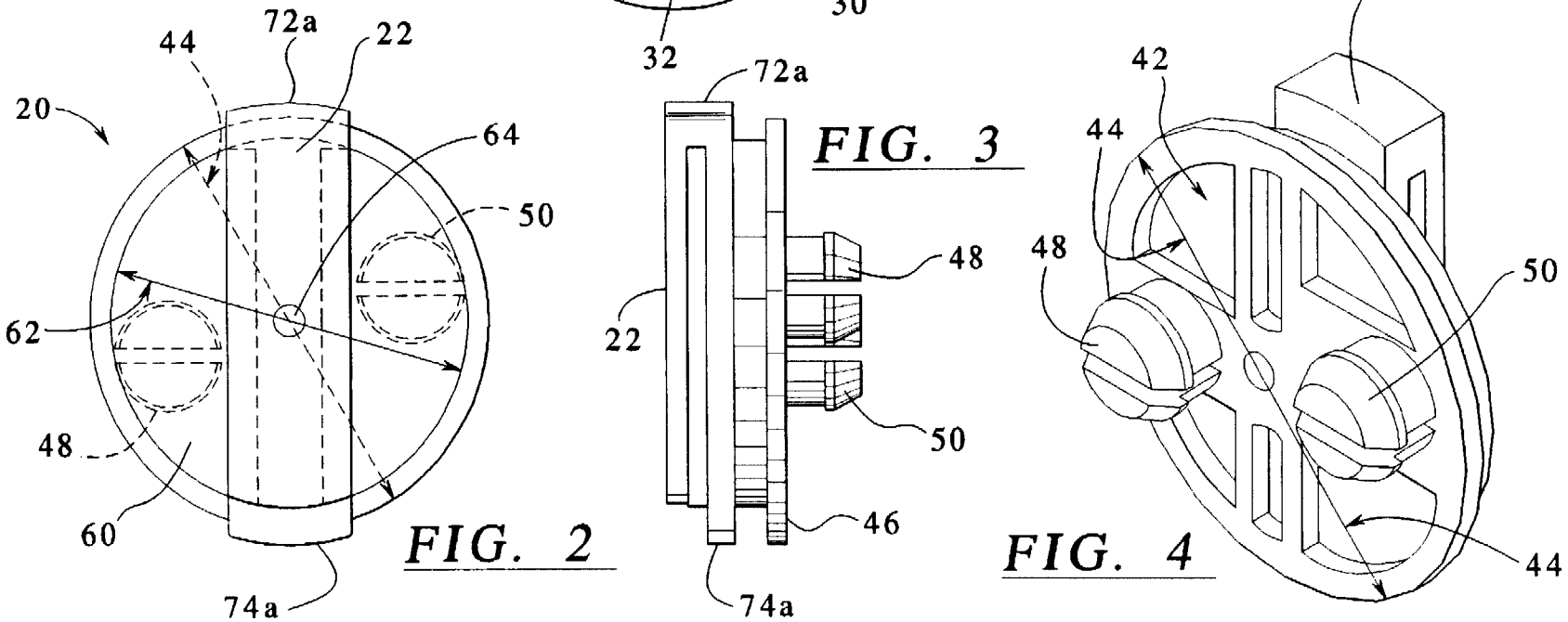
FIG. 2
FIG. 3
FIG. 4

LOUVRE WINDOW CLIP ASSEMBLY

BACKGROUND OF THE INVENTION

The invention relates to a louvre window clip, and more particularly, to a louvre window clip assembly that is capable of replacing a louvre window support piece without having to remove an entire louvre window frame.

Louvre windows are glass window blades extending in parallel across a window frame. Louvre window clips are secured to the window frame and used to hold the glass blades of the louvre window in place. Each end of the glass window blade is supported in a glass receiving groove on a front side of the louvre clip. The back side of the louvre window clips are connected to an opening and closing mechanism attached to the frame member of the louvre window. The mechanism allows the louvre window clips to rotate to open and close the glass blades in unison.

A common type of louvered window utilized today, for example U.S. Pat. No. 2,770,853, involves a metallic frame member which is received in a window opening of a building structure. The frame, on one side, contains an actuating mechanism to effect movement of the glass blades between the closed overlapping position and the partially rotated open position. The actuating mechanism may consist of a pair of parallel flattened rod members extending vertically along the metallic frame member at one side of the window. The rod members may be affixed to a crank or lever mechanism, as shown in U.S. Pat. No. 2,726,426, capable of moving them in opposite longitudinal directions. For various reasons, including safety, it is desired that these mechanisms be enclosed within the frame such that when the frame is mounted in the window opening, there is no easy access to the operating mechanism except for access to the crank or louvered lever on the inside. The individual glass panes, have their ends carried in louver clips. At least one louvre clip for each pane is then operatively affixed to the moving rods so that upon reverse longitudinal movement of the rods, the clip is caused to undergo a rotational movement. The louvre clips are positioned on the exterior of the frame member and are connected through openings in the frame member to the actuating mechanism.

While it has been known to make louvre clips in a single piece structure having a portion extending through the openings in the frame member for fixture to the rods, the attachments to the rod normally must be made from the interior side of the frame member by means such as rivets or bolts extending through the rods into the louvre clip portion projecting into the interior of the frame. In the event that such assemblies are to be shipped broken down for ease of transport, this has generally meant that the louvre clips must be affixed to the frame member's segment when shipped and that they must be secured against a rotation to minimize the potential for damage to the clips in shipment and storage.

Generally, the glass blades have been supported in metal clips, resulting in a glass-to-metal abutment. In order to provide more resilient means for holding the glass in place, plastic clips have been developed. However, due to inclement conditions and/or usage, the clip may break, crack, or chip. Thus, the damaged louvre window clip must be replaced by a new one.

Such single piece clips have the disadvantage that if the clip becomes broken, a replacement can only be effectuated by obtaining access to the interior of the frame member. After the frame is seated in the window opening, clip replacement in such cases may require extensive disassembly of the entire louvre window.

While it has been known to manufacture the clip and operating mechanism connection in two pieces, normally such two piece assemblies are joined together by screws or the like internally of the frame; again requiring disassembly of the frame in order to replace the clip.

If the glass receiving portion of the louvre window clip is damaged or broken, the entire frame member of the window frame must be removed in order to remove the damaged clip. This process may require the removal of all the glass window panes from their respective louvre clips in order to remove the frame member of the window frame. The frame member must then be removed to access the interior wall of the frame member. Access to the interior wall of the frame member is necessary to disengage the damaged louvre window clip from the frame member and replace the damaged louvre window clip with a new one. After the damaged louvre clip has been replaced, the frame member is then reinserted into the window frame and each and every glass pane is inserted into its respective louvre window clip. This process takes an extreme amount of time.

It is generally desired that the clip be firmly affixed to the frame member so that the clip will not fall away from the frame member in the event that the glass pane is not in place or is removed or broken. For this reason, internal attachments have an advantage in that they secure the clip semi-permanently to the frame. Nevertheless, since it is possible for clips themselves to become broken, chipped, damaged or otherwise inoperative, it is desirable to be able to replace clips periodically. It would be an advance to be able to make such a replacement without having to disassemble the frame or obtain access to the interior of the frame. It would also be desirable to be able to preassemble the frame with the operating mechanism but without the Louvre clips attached since this would provide for a more secure and compact shipment and greater ease of storage. This is particularly true since frequently it may be desired to provide the ultimate customer with clips of a different color or finish to match a desired decor.

SUMMARY OF THE INVENTION

It is an object of the invention to provide a louvre window clip assembly for use with a window frame member that is replaceable from the exterior side of the frame member.

It is a further object of the invention to provide a louvre window clip assembly that may be replaced without having to disassemble the frame member or obtain access to the interior of the frame.

It is a further object of the invention to preassemble the frame member with the operating mechanism but without the louvre clips attached.

It is a further object of the invention to provide a louvre window clip assembly that is rotatably securable to the frame member.

It is a further object of the invention to provide a louvre window clip assembly which reduces the time required to replace a damaged louvre window clip.

It is a further object of the invention to provide a louvre window clip assembly that may be replaced without having to remove the plurality of louvre window clips attached in parallel to the damaged louvre window clip.

The invention includes a hub and clip assembly in which the clip is fastened to the hub so that the clip is positioned on the exterior of a window frame and the hub is positioned on the interior of the window frame. The clip and the hub are cooperatively shaped in order to properly fasten to one another. The clip is secured to the hub so that the clip and the hub simultaneously rotate about an axis that is perpendicular to the frame. The clip is capable of being removed from the hub without having to access the interior of the window frame.

BRIEF DESCRIPTION OF THE DRAWINGS

FIG. 1 is a rear view of the clip section of the invention.

FIG. 2 is a front view of the hub section of the invention.

FIG. 3 is a side view of the hub.

FIG. 4 is a perspective rear view of the hub.

DETAILED DESCRIPTION OF THE PREFERRED EMBODIMENTS

Figure 5:
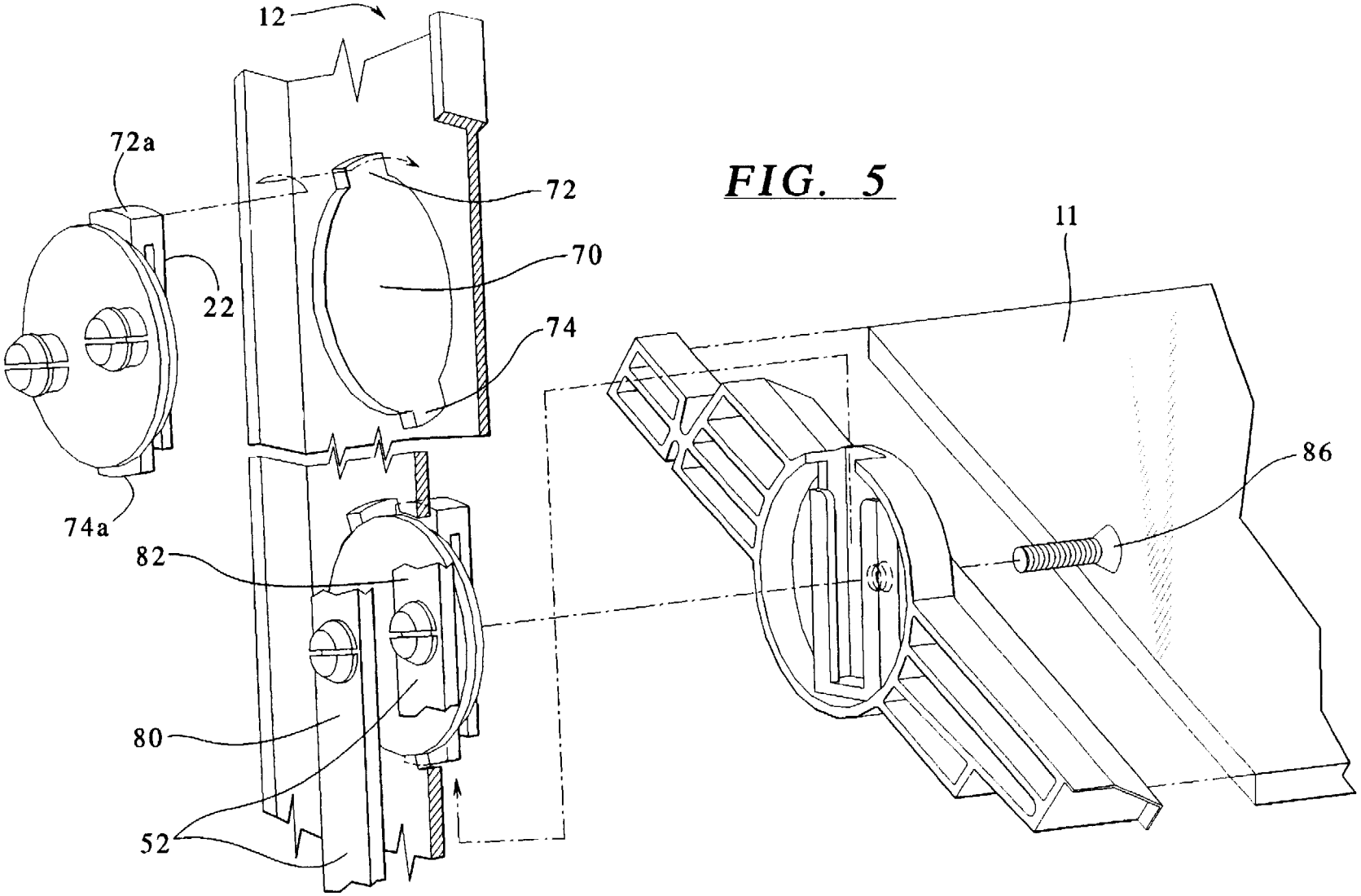
FIG. 5 is a perspective exploded view of the installation of the invention in a frame member.

The louvre clip of the present invention consists of two component parts as shown in FIGS. 1 and 2. A molded plastic clip portion 10 carries a louvre window glass pane 11 (see FIG. 5) and is received on an exterior of a frame member 12 (FIG. 5). An interior hub portion 20 is primarily received interior of the frame member 12 and has a connecting portion 22 which projects through the frame member 20 and indexes with the clip portion 10 to connect the hub portion 12 and the clip portion 10 together.

FIG. 1 illustrates a backside 24 of the clip portion 10 of the present invention. A front side 26 (see FIG. 7) of the clip portion 10 is designed to receive the glass louvre window pane 11 in a glass receiving groove 28. The backside 24 of the clip portion 10 has an inner diameter 30 and an outer diameter 32. A mounting hole 34 is positioned in the center of the clip 10 and aligned with the glass receiving groove 28 on the front side 26 of the clip 10. The backside 24 of the clip portion 10 also has an engagement section 40 (shown in FIG. 1 as a U-shaped groove). The engagement section 40 is designed to receive the connecting portion 22 of the hub 20.

FIGS. 2, 3 and 4 illustrate various views of the hub 20. The hub 20 is generally disc-shaped having an interior section 42 with an enlarged diameter 44. The interior section 42 has a back face 46 with two projecting members 48 and 50 as connectors for cooperating with an operating mechanism 52 (as shown in FIG. 5). A front side 60 of the hub 20 has a smaller diameter section 62 that is adapted to project through the frame member 12. The front side 60 of the hub 20 cooperatively engages with the backside 24 of the clip portion 10 via the connecting portion 22 or other cooperatively aligned engagement. The hub 20 also has a mounting hole 64 located in the center of the hub 20. The mounting hole 64 of the hub 20 cooperatively aligns with the mounting hole 34 of the clip section 10 to accept a screw mounting (not shown). The connecting portion 22, shown here as a tongue, projects beyond an outer diameter 62 of the front side 60 of the hub 20 so that it may be slidably mounted into the groove 40 of the clip section 10.

FIG. 5 illustrates the installation of an embodiment of the invention onto the frame member 12. The frame member 12 is provided with a plurality of spaced apart generally circular openings 70. Each of the openings 70 has diametrically opposed recesses 72, 74 for receiving the tangs **72*a*, 74*a* of the tongue 22. The smaller diameter section 62 of the hub 20 is designed to be received in the circular opening 70 and to be rotatable with respect thereto. The enlarged diameter portion 44 has a diameter larger than the opening 70 whereby the hub 20 cannot be projected completely through the opening 70 in the frame 12** from the interior.

The connecting portion of tongue 22 projects above the reduced diameter section 62 on the exterior portion thereof and extends beyond the diameter 22 such that the hub 20 can only be inserted into the opening 70 when the connecting portion 22 is aligned with the recesses 72, 74. Thereafter, rotation of the hub 20 will entrap the metal of the frame member 12 between the projections of the ends of the connecting portion 62 in the enlarged diameter section 44 to retain the hub 20 in position in the frame 12. The location of the recesses 72, 74 is chosen with respect to the operating rotation of the hub 20, determined by the movement of the operating mechanism 52, consisting of hub control bars 80, 82, such that the bosses 72, 74 lie in an angular position not encountered by normal rotation of the hub 20 during opening and closing of the louvre window blades. In this manner, once the hub 20 is inserted into the frame member 12 and the bars 80 and 82 are connected to the hub 20 via the split connectors 48, 50, the hubs 20 will not be rotatable to a position permitting withdrawal of the hubs 20 from the frame member 12 during normal operation.

Figure 6:
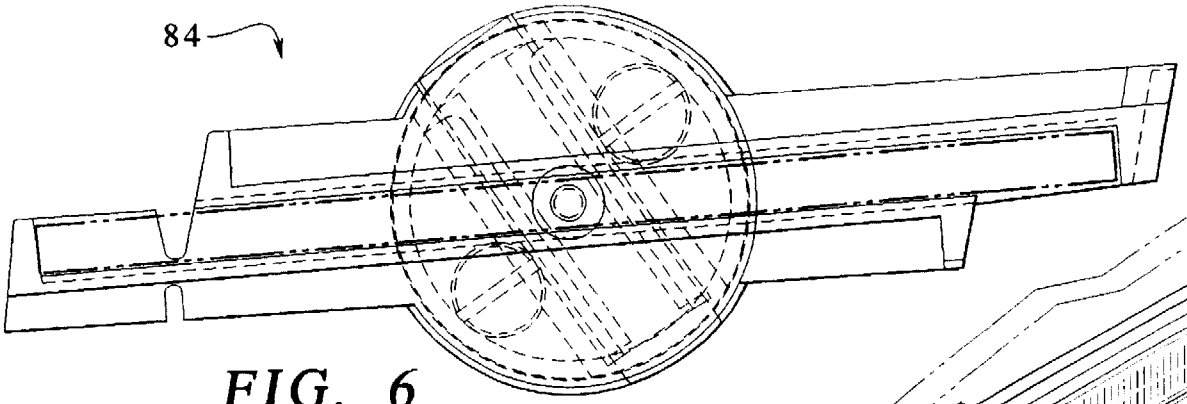
FIG. 6 is a perspective view of the assembled invention.

After the hub 20 is secured to the frame member 12 via the operating bars 48, 50, the U-shaped groove 40 on the clip section 10, slidably engages with the connecting portion 22 of the hub 20 forming the louvre window clip assembly 84 (further shown in FIG. 6). When the clip section 10 engages with the hub 20 the mounting holes 34 and 64 should be aligned. A mounting screw 86 or other mounting device, secures the clip section 10 to the hub 20. The louvre glass window pane 11 may then be installed into the glass receiving groove 28 on the front side 26 of the clip section 10. Once the glass window pane 11 is installed, the mounting screw 86 is no longer accessible unless the glass pane 11 is removed. This provides a security measure.

FIG. 6 shows the assembled invention 84. The hub 20 and the clip section 10 are engaged to form one louvre window clip assembly 84. The diameter 44 of the hub 20 is less than the inner diameter 30 of the clip section 10. This permits the hub 20 to uniformly fit within the clip section 10. An advantage of this uniform design is to protect against inclement weather conditions such as rain and wind.

Figure 7:
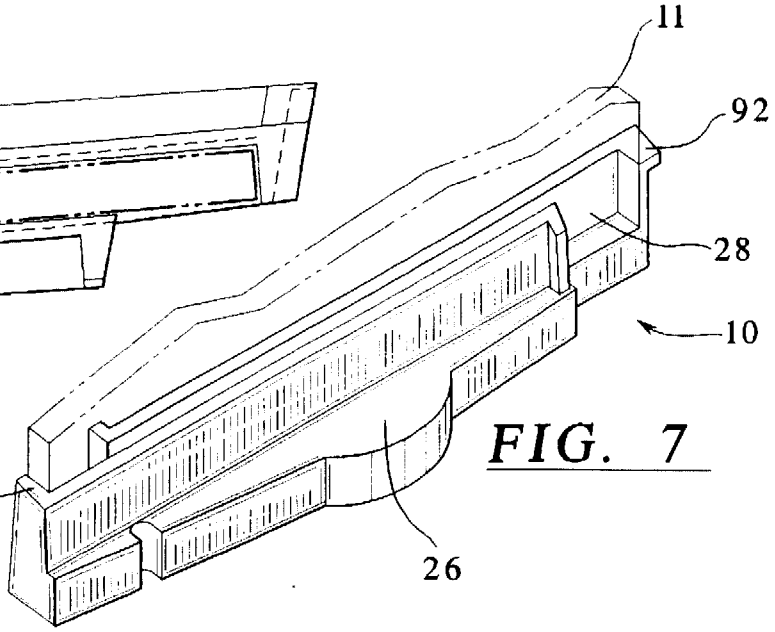
FIG. 7 is a perspective view of the clip section and a glass pane.

FIG. 7 is a perspective front view of the clip section 10. A louvre window glass pane 11 is received by the glass receiving groove 28 of the clip section 10. The receiving groove 28 can be adapted to accommodate various materials other than glass. These materials include, but are not limited to, wood and vinyl slats of varying widths. The width of the receiving groove 28 may even be greater than the outer diameter 32 of the clip section 10 in order to accommodate the slats. Two edges 92, 94 of the clip section 10 are adapted to prevent the glass window pane 11 from sliding out of the glass receiving groove 28.

Figure 8:
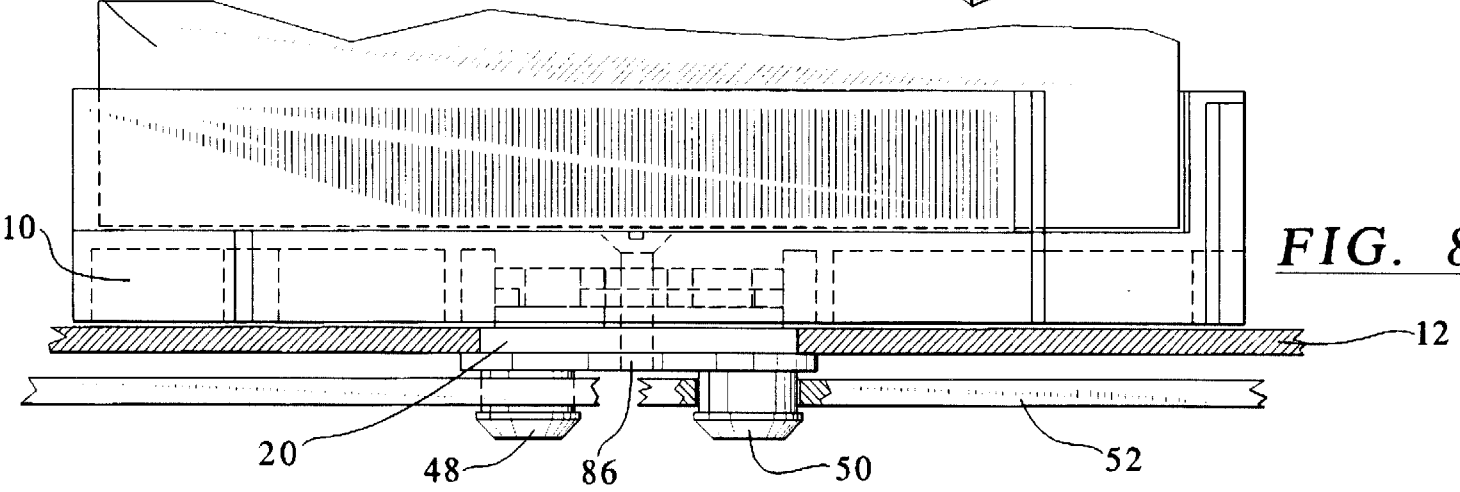
FIG. 8 is a sectional view of the invention with the frame member.

FIG. 8 is a side view of the invention 84 and the window frame member 12. The hub 20 has been inserted through the frame member 12. The clip section 10 is cooperatively engaged with the hub 20 and the mounting screw 86 has been inserted. The two projecting members 48 and 50 are cooperatively aligned with the operating mechanism 52 on the interior of the frame member 12. The glass window pane 1 1 is inserted into the clip section 10.

Figure 9:
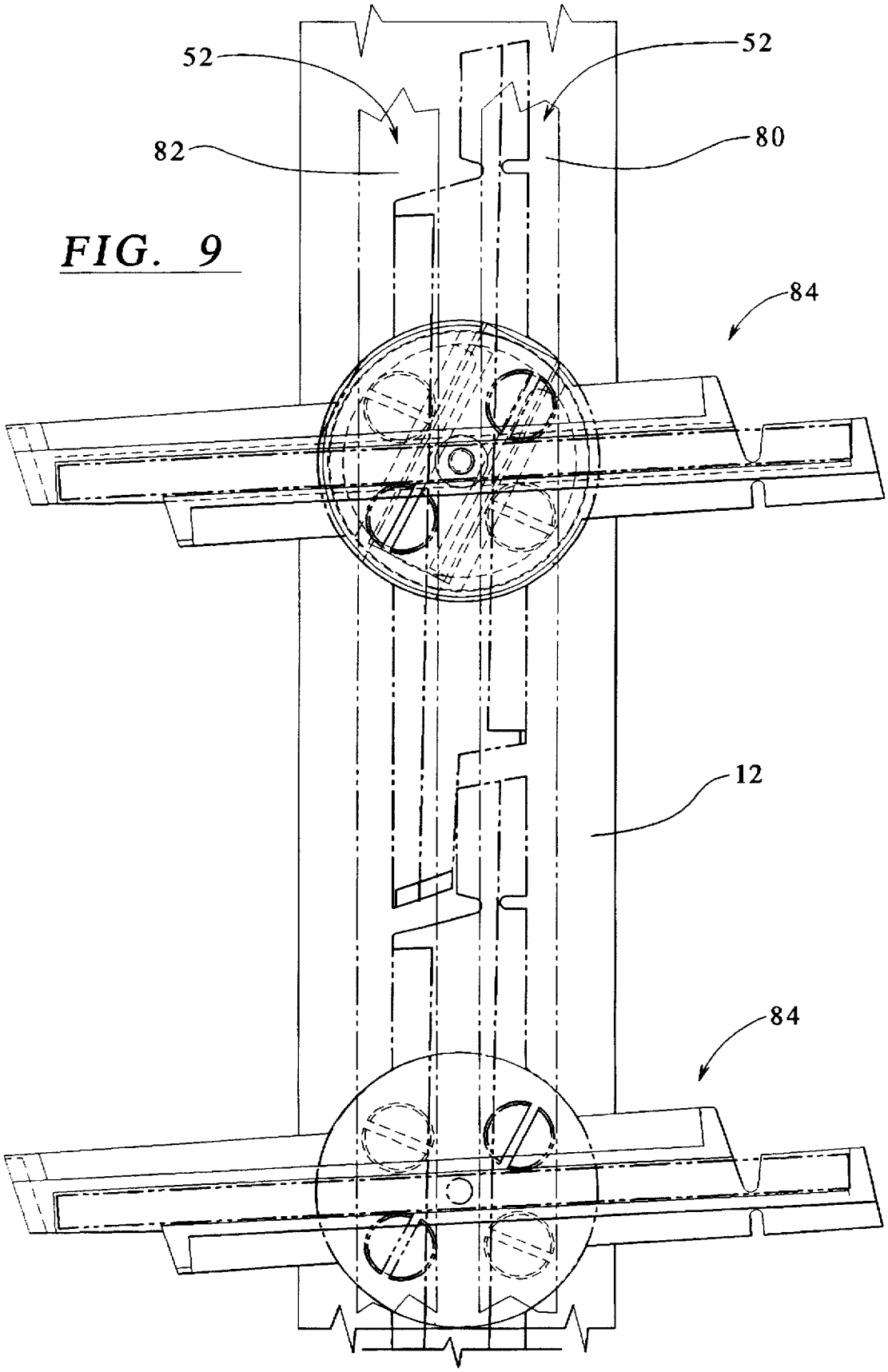
FIG. 9 is a perspective view of multiple embodiments working in unison.

FIG. 9 shows a plurality of louvre window clip assemblies 84 installed in a window frame member 12. The plurality of louvre window clip assemblies 84 operate in unison via the operating mechanism 52. The operating bars 80 and 82 move in opposite direction to one another when activated. This movement provides a rotational torque causing the window clip assemblies 84 to rotate approximately ninety (90) degrees so that the glass window panes 11 completely open and close. As the louvre window clip assemblies 84 are closed they lock into place.

The present invention is subject to many variations, modifications and changes in detail. It is intended that all matter described throughout the specification and shown in the accompanying drawings be considered illustrative only. Accordingly, it is intended that the invention be limited only by the spirit and scope of the appended claims.

What is claimed is:

1. A two piece louvre window clip assembly operated with a frame member having an interior side and opening through the frame member, the opening of the frame member having a diameter, the assembly comprising:

a hub having insulating portions, the hub further comprising a front face and a rear face, the front face of the hub being connected to a tongue, the hub further comprising an outer diameter, the tongue comprising a tang that extends radially outward past the outer diameter of the hub and radially outward past the diameter of the opening;

said hub received through the opening of the frame member and entrapped in the frame member with portions of the frame member between projecting portions of the hub;

a clip having a front side and a back side, the front side having a glass receiving groove, the back side comprising a u-shaped groove, the tongue of the hub being slidably connected to the groove of the clip.

2. The louvre window clip assembly in claim 1, a screw for further removably securing the clip to the hub.

3. A louvre window assembly comprising:

an elongated metal frame member having a length and a plurality of openings therethrough spaced along the length of the frame member, the frame member having an interior and an exterior;

a pair of longitudinally movable bar members received interior of the frame member movable along the length of the frame member;

a plurality of louvre clip hub members affixed to the frame member, each of the louvre clip hub members having portions interior and exterior of the frame member;

the exterior portion of each of the louvre clip hub members each having a tongue with a radially outwardly protruding tang that extends radially beyond a greater portion of each of the openings whereby each of the louvre clip hub members entrap the frame member between the interior and exterior portions;

the movable bar members being connected to the interior portion of the louvre clip hub members whereby opposed movements of the bar members cause rotation of the louvre clip hub members in the openings;

a plurality of glass clips having interior portions with a groove for slidably receiving a tongue of one of the hub members for forming an attachment therebetween, the attachment effective to transfer rotation of the louvre clip hub members through the glass clips.

4. The louvre window assembly of claim 3 wherein each of the openings of the frame member further comprise a recess for accommodating the tangs of the tongues of the louvre clip hub members during insertion of the exterior portions of the louvre clip hub members through the openings in the frame member.

5. A louvre window clip assembly pivotally connecting an end of a louvre window blade to at least one control bar with a frame member disposed therebetween, the frame member having an opening extending from an interior side of the frame member to an exterior side of the frame member, the control bar being disposed along the interior side of the frame member, the opening having a diameter, the clip assembly comprising:

a hub comprising a rear side that extends through the opening in the frame member, the rear side of the hub comprising a tongue, the tongue being slidably accommodated in a groove of a clip member to detachably connect the hub to the clip member so that the clip member is disposed on the exterior side of the frame member, the hub further comprising a front side disposed at the interior side of the frame member, the front side of the hub being connected to the control bar, the front side of the hub having a diameter, the tongue further comprising at least one tang that projects radially outwardly beyond the diameter of the front side of the hub and beyond the diameter of the opening to secure the hub to the frame member.

6. The louvre window clip assembly in claim 5, wherein a screw is positioned to further secure the clip to the hub.

7. The louvre window clip assembly of claim 5 wherein the diameter of the front side of the hub is smaller than the diameter of the opening so that the front side of the hub is journaled in the opening of the frame member.

8. The louvre window clip assembly of claim 5 wherein the front side of the hub is detachably connected to the control bar.

* * * * *